US005136116A

United States Patent [19]

Ohhazama et al.

[11] Patent Number: 5,136,116

[45] Date of Patent: Aug. 4, 1992

[54] OIL COMPOSITION FOR ELECTRICAL DISCHARGE MACHINING

[75] Inventors: Susumu Ohhazama, Tokyo; Fujio Ohta, Yokohama, both of Japan

[73] Assignee: Nippon Oil Co., Ltd., Japan

[21] Appl. No.: 734,055

[22] Filed: Jul. 22, 1991

Related U.S. Application Data

[63] Continuation of Ser. No. 607,840, Nov. 1, 1990, abandoned, which is a continuation of Ser. No. 399,907, Aug. 29, 1989, abandoned.

[30] Foreign Application Priority Data

Sep. 8, 1988 [JP] Japan ..... 63-225474

[51] Int. Cl.[5] ..... H01B 3/22

[52] U.S. Cl. ..... 585/6.6; 585/6.3; 252/52 R; 252/56 R; 252/49.6

[58] Field of Search ..... 252/49.6, 52 R, 56 R; 585/6.3, 6.6

[56] References Cited

U.S. PATENT DOCUMENTS

| | | | |
|---|---|---|---|
| 4,081,393 | 3/1978 | Berthelot et al. | 585/6.6 |
| 4,542,246 | 9/1985 | Matsunaga et al. | 585/6.6 |
| 4,731,495 | 3/1988 | Katayama | 585/6.6 |

FOREIGN PATENT DOCUMENTS

| | | | |
|---|---|---|---|
| 2307033 | 4/1975 | France | 585/6.6 |

*Primary Examiner*—Jacqueline Howard
*Attorney, Agent, or Firm*—Bruce L. Adams; Van C. Wilks

[57] ABSTRACT

Oil compositions are disclosed for use in electrical discharge machining. Selected mineral or synthetic oils or their blends are combined with specified amounts of selected alkylbenzenes. Machining speed is greatly improved.

11 Claims, No Drawings

OIL COMPOSITION FOR ELECTRICAL DISCHARGE MACHINING

This is a continuation application of Ser. No. 607,840 filed Nov. 1, 1990 which in turn is a continuation application of Ser. No. 399,907 filed Aug. 29, 1989 both now abandoned.

BACKGROUND OF THE INVENTION

1. Field of the Invention

This invention is directed to oil compositions for use in electrical discharge machining, also called electrical spark machining.

2. Prior Art

Electrical discharge machining is known as a process for the removal of electrically conductive materials from workpieces by taking advantage of artificial electric sparks. In general, this process is used to form holes of varying shapes in materials of poor machinability and to make cavities in steel dies. It permits accurate machining and thus finds extensive application to not only the formation of molds but also various other sectors of industry.

The above machining process is effected with the use of a cutting fluid disposed in a space between an electrode and a workpiece and serving to generate an electric spark. Certain cutting fluids have been used to this end in which are included kerosines, naphthenic hydrocarbons, n-paraffins, iso-paraffins and the like. However, such known oils have still much to be desired because they involve prolonged machining time and hence reduced production rate.

SUMMARY OF THE INVENTION

It has now been found that electrical discharge machining efficiency can be enhanced by the use of cutting fluids made up of specified alkylbenzenes combined with selected base oils. The present invention therefore seeks to provide a novel oil composition for use in electrical discharge machining which will enable machining operations to be accomplished at higher speed, thus contributing to greater economy.

The above and other objects and advantages of the invention will become better understood from the following description.

More specifically, the invention provides an oil composition adapted to be used for electrical discharge machining which comprises as a base oil either one or both of a mineral oil and a synthetic oil and as an additive component at least one alkylbenzene in an amount of from 10 to 40 percent by weight of the total composition.

PREFERRED EMBODIMENTS

An oil composition contemplated under the present invention is comprised essentially of a selected base oil and a selected alkylbenzene of a specified structure.

Base oils used herein are not specifically restricted and may suitably be chosen from those mineral and synthetic oils commonly accepted as cutting fluids in the industry. Mineral oils typically include kerosines, spindle oils, machine oils and the like. Suitable examples of synthetic oils include polybutenes, α-olefin oligomers, alkylnaphthalene, diesters, polyol esters, polyglycols, silicone oils, n-paraffins, iso-paraffins and the like. The base oil may comprise either one or both of the mineral and synthetic types of oils. n-Paraffins or iso-paraffins or their blends are particularly preferred in the practice of the invention.

The base oil should preferably have a kinematic viscosity 1.4 to 3.5 cSt at 40° C.

Alkylbenzenes eligible as an additive component for purposes of the invention are one or more members of the formula

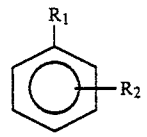

where $R_1$ is an alkyl group having 9 to 40 carbon atoms, and $R_2$ is a hydrogen atom or an alkyl group similar to that of $R_1$.

Any one of alkyl groups of 9 to 24 carbon atoms is particularly preferred at the position of $R_1$. The substituent for $R_2$ is preferably either one of alkyl groups of 9 to 24 carbon atoms and more preferably a hydrogen atom. The above specified alkyl groups may be of a straight or branched configuration.

The alkylbenzene should have a kinematic viscosity of 5 to 20 cSt and more preferably 5 to 16 cSt at 40° C.

The alkylbenzene should importantly be used in an amount of 10 to 40% and more preferably 20 to 40% by weight based on the total weight of the composition. The component if smaller than 10% would show no appreciable increase in machining speed and if larger than 40% would produce no better results, entailing cost burdens.

When it is found desirable to further improve machining efficiency, the composition of the invention may be admixed with various other additives selected for example from antioxidants, polybutenes, ethylene-propylene copolymers and the like.

EXAMPLES

The present invention will be further described by way of the following examples which are provided for purposes of illustration only.

The base oils and alkylbenzenes used in these examples were indicated hereunder together with the details as regards the test machine.

Different oil compositions were prepared and tested, each run being conducted in pairs with an alkylbenzene added and omitted, with the results tabulated below.

| | cSt at 40° C. |
|---|---|
| base oil | |
| n-paraffin | 1.75 |
| iso-paraffin | 2.13 |
| mineral oil | 1.66 |
| additive component | |
| alkylbenzene | 8.44 |
| electrical discharge machine | |
| type: M35-C5-G30, Mitsubishi Electric Corp. | |
| dial setting: | |
| tooling setting | 1 |
| tooling microadjustment | 2 |
| pulse width | 6 |
| rest time | 6 |
| gap adjustment | 3 |
| discharge stability | ON |
| discharge time | 3 |
| flushing time | 3 |
| electrode polarity: ⊕ | |

-continued

| | cSt at 40° C. |
|---|---|
| electrode: Cu with a spherical tip of 5.0 mmr | |

INVENTIVE EXAMPLE 1/COMPARATIVE EXAMPLE 1

Performance evaluation was made of an inventive fluid containing n-paraffin and an alkylbenzene compared to a fluid containing the same oil alone. Both fluids were used to finish an SKDll workpiece. Machining speed was determined which was closely correlated to the relative amount of work machined for a predetermined length of time and expressed in milligram per 40 minutes.

INVENTIVE EXAMPLE 2/COMPARATIVE EXAMPLE 2

The procedure of Inventive Example 1 was followed except that S55C was used in place of SKDll.

INVENTIVE EXAMPLE 3/COMPARATIVE EXAMPLE 3

Testing was conducted as was in Inventive Example 1 except for the replacement of the base oil by iso-paraffin.

INVENTIVE EXAMPLE 4/COMPARATIVE EXAMPLE 4

A mineral oil was substituted for n-paraffin, and the same evaluation was made as in Inventive Example 1.

The oil compositions according to invention have been found to exhibit notably high speed of machinability as evidenced by the tabulated data. This is interpreted to mean that the beneficial effects of the invention are attributed to the addition of selected alkylbenzenes.

Although the invention has been described in conjunction with its specific embodiments, it will be noted that many changes and modifications may be made as conceived by those skilled in the art within the scope of the appended claims.

TABLE

| run | workpiece | base oil (wt %) | alkyl-benzene (wt %) | machining speed (mg/40 min) |
|---|---|---|---|---|
| Inventive Example 1 | SKD11 | n-paraffin (65) | 35 | 106.3 |
| Comparative Example 1 | " | n-paraffin (100) | — | 90.5 |
| Inventive Example 2 | S55C | n-paraffin (65) | 35 | 101.6 |
| Comparative Example 2 | " | n-paraffin (100) | — | 88.7 |
| Inventive Example 3 | SKD11 | iso-paraffin (87) | 13 | 100.4 |
| Comparative Example 3 | " | iso-paraffin (100) | — | 92.8 |
| Inventive Example 4 | SKD11 | mineral oil (80) | 20 | 104.5 |
| Comparative Example 4 | " | mineral oil (100) | — | 91.9 |

What is claimed is:

1. In a process of electrical discharge machining, the improvement comprising: employing a cutting fluid which comprises a base oil having characteristics adapting it for use in the operation of electrical discharge machinery and which is based on a mineral oil or a synthetic oil or a mixture thereof, and an additive component effective to increase the speed of operation of said machinery and which is at least one alkylbenzene in an amount of from 10 to 40 percent by weight of the total cutting fluid.

2. A process as defined in claim 1 wherein said mineral oil is selected from the group consisting of kerosines, spindle oils and machine oils.

3. A process defined in claim 1 wherein said synthetic oil is selected from the group consisting of polybutenes, α-olefin oligomers, alkylnapthalene, diesters, polyol esters, polyglycols, silicone oils, n-paraffins and iso-paraffins.

4. A process defined in claim 1 wherein said base oil is selected from the group consisting of n-paraffins, iso-paraffins and combinations thereof.

5. A process defined in claim 1 wherein said alkylbenzene is represented by the formula

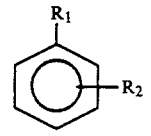

where $R_1$ is an alkyl group having a carbon number of from 9 to 40 and $R_2$ is a hydrogen atom or an alkyl group having a carbon number of from 9 to 40.

6. In a process of electrical discharge machining, the improvement comprising: employing a cutting fluid which comprises a base oil having characteristics adapting it for use in the operation of electrical discharge machinery and which is based on a mineral oil, a synthetic oil or a mixture thereof, and an additive component effective to increase the speed of operation of said machinery and which is at least one alkylbenzene in an amount of from 10 to 40 percent by weight of the total cutting fluid, said base oil having a kinematic viscosity of 1.4 to 3.5 centistokes at 40° C., and said alkylbenzene having a kinematic viscosity of 5 to 16 centistokes at 40° C.

7. A process as defined in claim 6; wherein said mineral oil is selected from the group consisting of kerosines, spindle oils and machine oils.

8. A process as defined in claim 6; wherein said synthetic oil is selected from the group consisting of polybutenes, α-olefin oligomers, alkylnaphthalene, diesters, polyol esters, polyglycols, silicone oils, n-paraffins and iso-paraffins.

9. A process as defined in claim 6; wherein said base oil is selected from the group consisting of n-paraffins, iso-paraffins and combinations thereof.

10. A process as defined in claim 6; wherein said alkylbenzene is represented by the formula

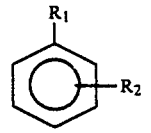

where $R_1$ is an alkyl group having a carbon number of from 9 to 40, and $R_2$ is a hydrogen atom or an alkyl group having a carbon number of from 9 to 40.

11. In a process of electrical discharge machining, the improvement comprising: employing a cutting fluid composed of a base oil having characteristics adapting it for use in the operation of electrical discharge machinery and which is based of n-paraffins, iso-paraffins or mixtures thereof, and an additive component effective to increase the speed of operation of said machinery and which is an alkylbenzene represented by the formula

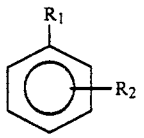

where $R_1$ is an alkyl group having a carbon number of from 9 to 40, and $R_2$ is a hydrogen atom, in an amount of from 20 to 40 percent by weight of the total cutting fluid, said base oil having a kinematic viscosity of 1.4 to 3.5 centistokes at 40° C., and said alkylbenzene having a kinematic viscosity of 5 to 16 centistokes at 40° C.

* * * * *